United States Patent [19]

Inoue et al.

[11] Patent Number: 4,737,944

[45] Date of Patent: Apr. 12, 1988

[54] ELECTRONIC TIMEPIECE

[75] Inventors: Yuichi Inoue; Hiroshi Odagiri; Hiroyuki Masaki; Shuji Ohtawa; Masao Kasuga, all of Tokyo, Japan

[73] Assignee: Seiko Instruments Inc., Tokyo, Japan

[21] Appl. No.: 35,093

[22] Filed: Apr. 6, 1987

[30] Foreign Application Priority Data

Apr. 8, 1986 [JP] Japan ..... 61-80720
Apr. 10, 1986 [JP] Japan ..... 61-83027

[51] Int. Cl.[4] ..... G04B 17/12
[52] U.S. Cl. ..... 368/201; 368/200
[58] Field of Search ..... 368/200–202

[56] References Cited

U.S. PATENT DOCUMENTS 4,373,821 2/1983 Morishile ..... 368/201
4,453,834 6/1984 Suzuki et al. ..... 368/201
4,456,386 6/1984 Dellea ..... 368/201
4,461,582 7/1984 Walther ..... 368/201

*Primary Examiner*—Bernard Roskoski
*Attorney, Agent, or Firm*—Bruce L. Adams; Van C. Wilks

[57] ABSTRACT

In a temperature gradient adjustor for a temperature-compensated electronic watch, the temperature gradient adjusting range can be widened without any drop in the temperature gradient adjusting resolution of a temperature sensitive oscillator by adding a roughly temperature gradient adjusting variable frequency divider for variably dividing the frequency of the output of a temperature sensitive oscillator and by operating the temperature gradient adjustor at a value which is prepared by adding a constant numerical value to temperature gradient adjusting numerical information.

A constant voltage supplying to a temperature sensitive oscillator can be finely adjusted from external side so as to optimize a linearity of frequency versus temperature characteristic.

4 Claims, 11 Drawing Sheets

ELECTRONIC TIMEPIECE

BACKGROUND OF THE INVENTION

1. Field of the Invention

The present invention relates to a temperature-compensated electronic watch having a temperature sensitive oscillator constructed in a MOS-IC.

2. Description of the Prior Art

In the prior art, the temperature gradient adjustor is operating with the temperature gradient adjusting numerical information only but without any roughly temperature gradient adjusting variable frequency divider interposed between the temperature sensitive oscillator and the temperature gradient adjustor.

The method of adjusting the temperature sensitive oscillator according to the prior art will be described in the following with reference to the accompanying drawings.

FIGS. 3 and 4 are block diagrams showing the basic constructions of the temperature sensitive oscillator adjusting method of the prior art.

FIG. 3 is a block diagram corresponding to the case in which the output signal frequency fs of the temperature sensitive oscillator varies linearly with the temperature, and FIG. 3 is a block diagram corresponding to the case in which the output signal period $\tau s$ of the temperature sensitive oscillator varies linearly with the temperature.

The temperature compensation will be described briefly with reference to FIG. 3. The temperature measurement is conducted at a constant time interval by a controller 6. When the instant for the temperature measurement comes, an offset adjusting counter 10 and a gradient adjusting counter 8 are set with adjusting numerical informations B and A, respectively, by the controller 6. Then, a latch 11 is set by the controller 6 the output signal fs of a temperature sensitive oscillator 7 begins to be inputted to the offset adjusting counter 10 via an AND gate 12. Simultaneously with this, a signal fc starts to be inputted from a frequency divider 2 to the gradient adjusting counter 8. When this gradient adjusting counter 8 is counted down by the adjusting numerical information A in response to the signal fc, a zero detector 9 conducts its zero detection to reset the latch 11 so that the AND gate 12 forbids the output signal fs of the temperature sensitive oscillator 7. As a result, the temperature information T obtained can be expressed by the following equation:

$$T=[A.fs/fc]+B-2^{l}.m \quad (1),$$

wherein $$fs=\alpha.\theta+fo \quad (2).$$

Here, letter l designates the number of bits of the offset adjusting counter 10, and letter m designates the number of times of overflows. Letter $\theta$ designates the temperature; letter fo designates the frequency at 0° C.; and letter $\alpha$ designates a temperature coefficient. Symbol "[]" designates the operation to round the numeral to nearest integer.

The temperature compensation in the case of FIG. 4 is substantially the same as that in the case of FIG. 3. The temperature information T of this case can be expressed by the following equation:

$$T=[A.\tau s.fc]+B-2^{l}.m \quad (3),$$

wherein $$\tau s=\beta.\theta+\tau o \quad (4).$$

Here, letter $\tau o$ designates the period of the temperature sensitive oscillator at 0° C., and letter $\beta$ designates a temperature coefficient.

The temperature gradient adjustors thus constructed are accompanied by a defect that the temperature gradient adjusting resolution (i.e., 1/A: the reciprocal number of the adjusting numerical information A) degrades the more as the frequency-temperature gradient or the frequency-temperature gradient of the temperature sensitive oscillator becomes the larger. In other words, the defect is that such a temperature gradient adjusting range is narrowed as can be used without any drop in the temperature gradient adjusting resolution.

The temperature gradient adjusting range will be determined in the following by substituting specific numerical values into the equations (1) and (2). If the temperature information T has a temperature depending term $T_\theta$, this term can be expressed by the following equation from the equations (1) and (2):

$$T_\theta=A.\alpha/fc.\theta] \quad (5).$$

The upper and lower limits of the value $\alpha$, i.e., the temperature gradient adjusting range will be calculated by substituting an appropriate specific numerical value into the equation (5).

If a condition is set such that the temperature information $T_\theta$ is varied by 1024 for the change of the temperature $\theta$ of 102.4° C., the following equation is obtained:

$$[A.\alpha/fc]=10\ (1/°C.) \quad (6).$$

If the gradient adjusting counter 8 is a counter of 10 bits, the adjusting numerical information A takes 10 bits. The signal fc to be used has 2048 Hz of the frequency divider.

In case the above-specified conditions are set, the adjusting numerical information A takes an integer of 0 to 1023 because of 10 bits but makes an error of 0.5 at the maximum of the adjustment because of the integer. The influences to be given to the temperature information by that error of 0.5 and the temperature gradient adjusting resolution become the larger for the smaller adjusting numerical information A. If the compensation temperature characteristics of quartz have an error not larger than 0.1 [ppm], for example, the temperature gradient adjusting resolution has to be not larger than 1/512, and the range of the adjusting numerical information A has to be from 512 to 1023. In this case, therefore, the adjustable range of the temperature gradient $\alpha$ is expressed by the following equation from the equation (6):

$$\alpha=20 \text{ to } 40(Hz/°C.).$$

In case the temperature gradient $\alpha$ is not larger than 20 (Hz/°C.), the adjusting numerical information A exceeds 1024 so that it cannot make an adjustment. In case the temperature gradient $\alpha$ is not larger than 40 (Hz/°C.), the adjusting numerical information A becomes equal to or smaller than 511 so that the temperature gradient adjusting resolution exceeds 1/512.

If the equations (3) and (4) are calculated under absolutely the same conditions as those of the equations (1) and (2), on the other hand, the adjustable range of the temperature gradient $\beta$ is expressed by the following equation:

$$\beta = 4.77 \text{ to } 9.54 (\mu\text{sec}/^\circ\text{C.}).$$

In this case, too, the adjusting numerical information A exceeds 1024 to make the adjustment impossible, if the temperature gradient $\beta$ becomes equal to or smaller than 4.77 ($\mu$sec/°C.), and becomes equal to or smaller than 511 to make the adjusting resolution equal to or more than 1/512 if the gradient $\beta$ exceeds 9.54 ($\mu$sec/°C.).

Even if the number of bits of the gradient adjusting counter 8 and the adjusting numerical information A are simply increased for widening the adjustable ranges of the temperature gradients $\alpha$ and $\beta$, another defect remains with that these widening purposes are difficult to realize partly because the time period for the temperature measurements is elongated and partly because a higher frequency has to be used as the signal.

SUMMARY OF THE INVENTION

It is an object of the present invention to provide an improved temperature gradient adjustor for a temperature-compensated electronic watch.

It is another object of the present invention to provide an improved voltage regulator for a temperature sensitive oscillator to optimize a linearity of frequency versus temperature from external side.

According to the present invention, by adding a roughly temperature gradient adjusting variable frequency divider for variably dividing the frequency of the output signal of the temperature sensitive oscillator and by operating the temperature gradient adjuster at a value which is prepared by adding a constant numerical value to the temperature gradient adjusting numerical information, the temperature gradient adjusting range can be widened without any drop in the temperature gradient adjusting resolution of the temperature sensitive oscillator.

According to the construction described above, the temperature gradient adjusting range can be widened without any drop in the temperature gradient adjusting resolution of the temperature sensitive oscillator.

DETAILED DESCRIPTION OF THE PREFERRED EMBODIMENT

The present invention will be described in the following in connection with the embodiment thereof with reference to the accompanying drawings.

Figure 1:
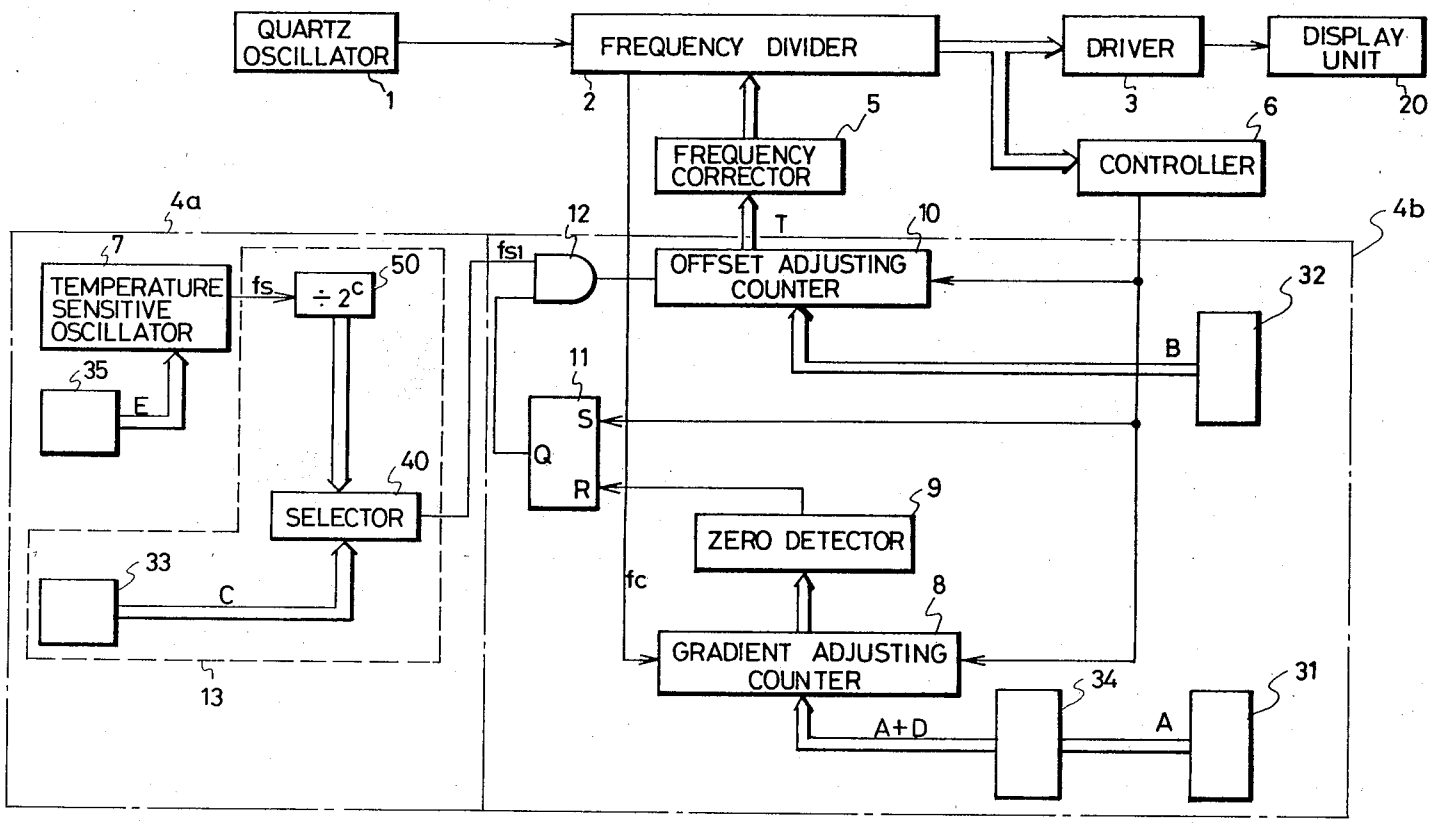
FIG. 1 is a block diagram showing an embodiment of the present invention.
Figure 2:
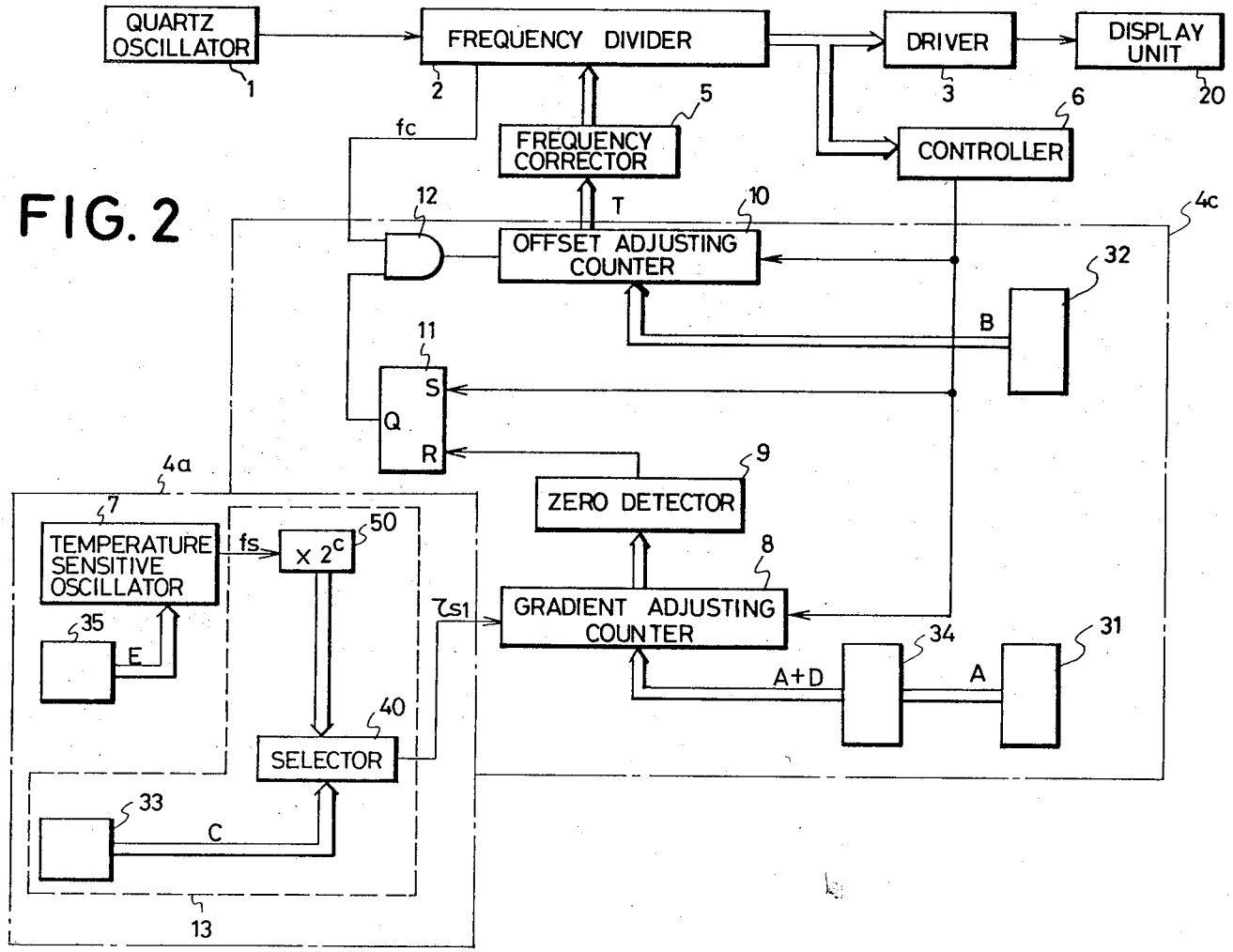
FIG. 2 is a block diagram showing another embodiment of the present invention.

FIGS. 1 and 2 are block diagrams showing the basic constructions of the temperature sensitive oscillator adjustor of the present invention.

Figure 3:
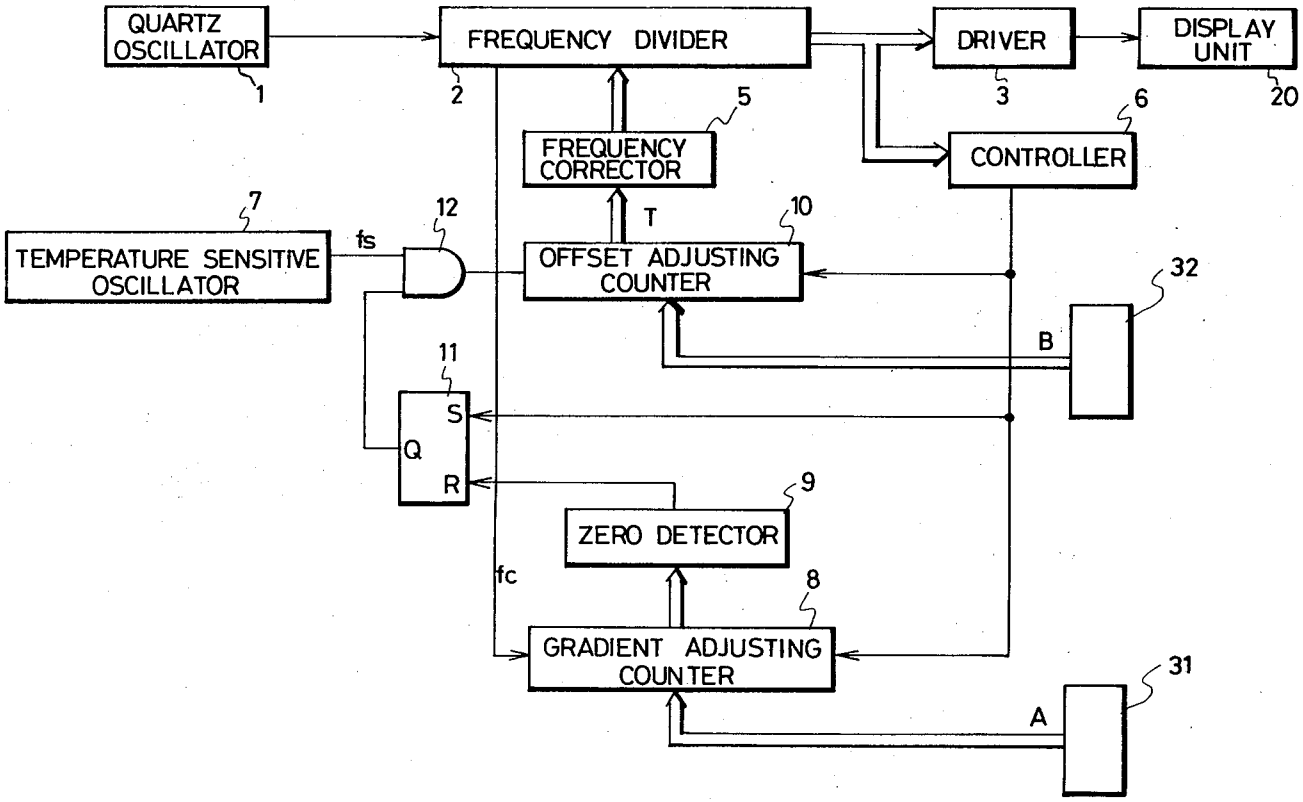
FIG. 3 PRIOR ART
FIG. 3 is a block diagram showing an example according to the prior art.
Figure 4:
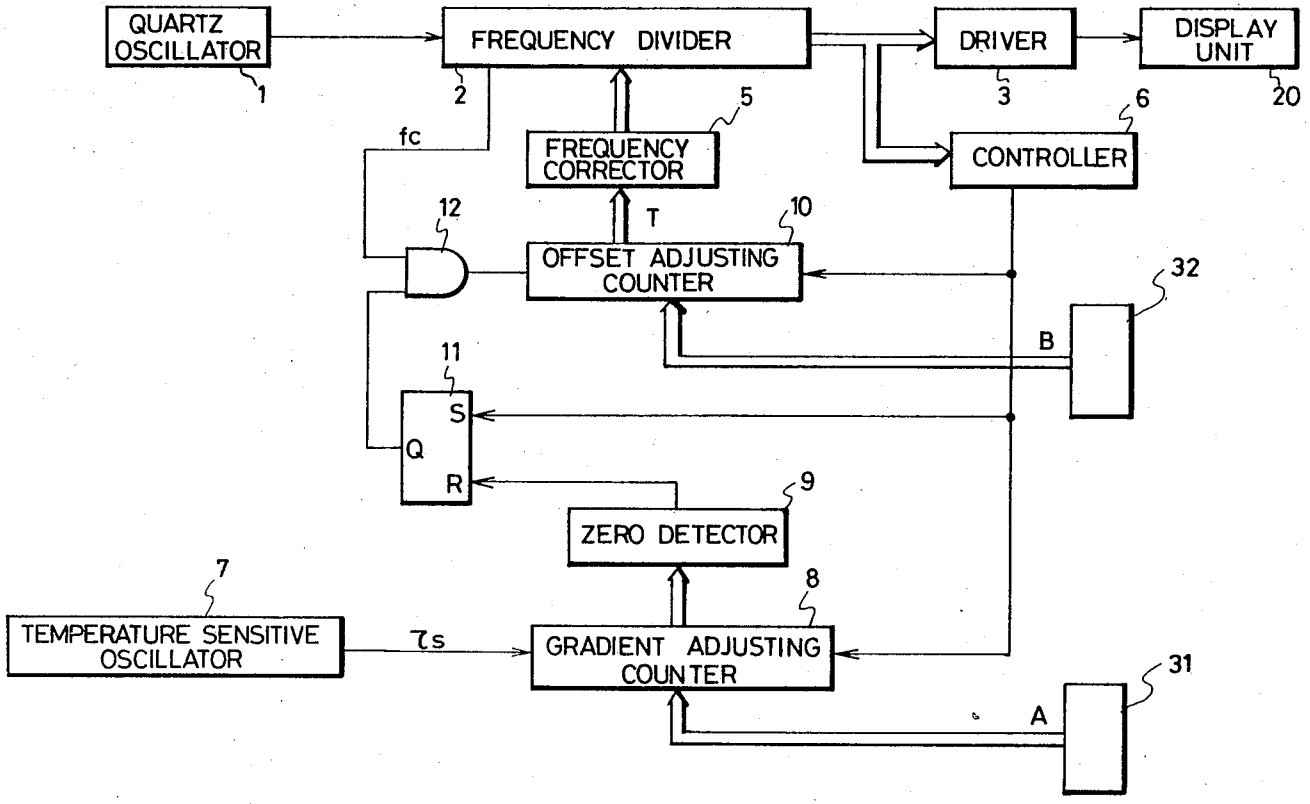
FIG. 4 PRIOR ART
FIG. 4 is a block diagram showing another example according to the prior art.

FIG. 1 is constructed by adding a roughly temperature gradient adjusting variable frequency divider 13 according to the present invention to the construction of FIG. 3 and by operating the temperature gradient adjustor at a value which is prepared by adding a constant numerical value D to the adjusting numerical information A. FIG. 2 is also constructed by adding the variable frequency divider 13 according to the present invention to the conventional example of FIG. 4 and by operating the temperature gradient adjustor at the value which is prepared by adding the numerical value D to the adjusting numerical information A.

The temperature compensation in the cases of FIGS. 1 and 2 are substantially the same as that of the aforementioned case of FIG. 3, and the temperature information T of FIG. 1 can be expressed by the following equation:

$$T = [(A+D).fs/2^c.fc] + B - 2^l.m \quad (7).$$

wherein $$fs = \alpha.\theta + fo \quad (2).$$

Letter D designates a constant numerical value to be added to the temperature gradient adjusting numerical information A, and letter C designates information concerning how many flip-flops are to be added for dividing the output signal of the temperature sensitive oscillator into one half. It is quite natural that the added numerical value D need not be added to the adjusting numerical value A but may take any construction if the output signal of the temperature sensitive oscillator never fails to be inputted to the offset adjusting counter for a constant period of time having no relation to the adjusting numerical value A. Likewise, the variable frequency dividing information C need not be constructed to specify how may flip-flops to be added, as shown in FIG. 1, but may take any construction if the frequency of the output signal of the temperature sensitive oscillator is variably divided.

The temperature information T in FIG. 2 can be expressed by the following equation:

$$T = [(A+D).\tau s.2^c.fc] + B - 2^l.m \quad (8).$$

wherein $$\tau s = \beta.\theta + \tau o \quad (4).$$

Figure 5A:
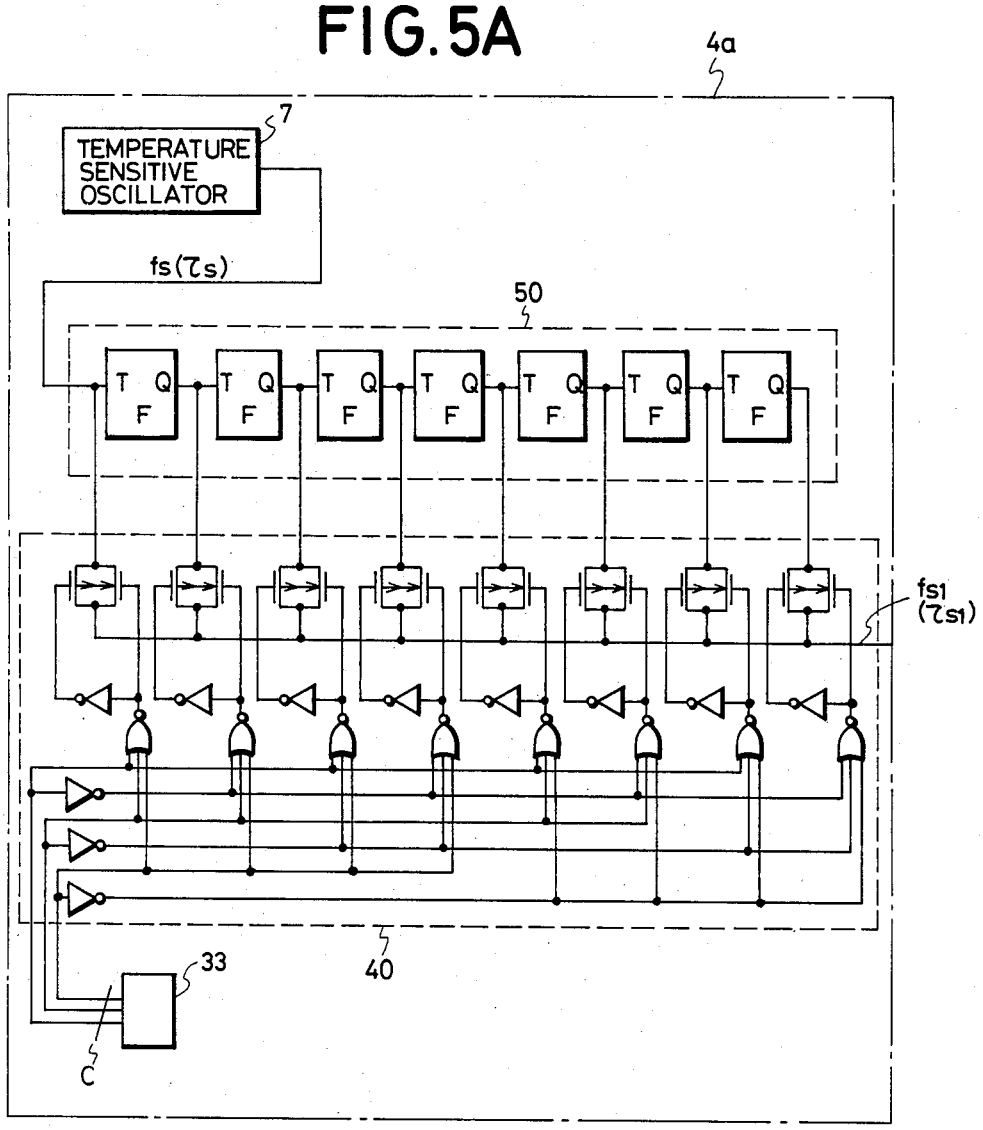
FIG. 5A is a diagram showing specifically the content of the block 4*a* appearing in FIGS. 1 and 2.
Figure 5B:
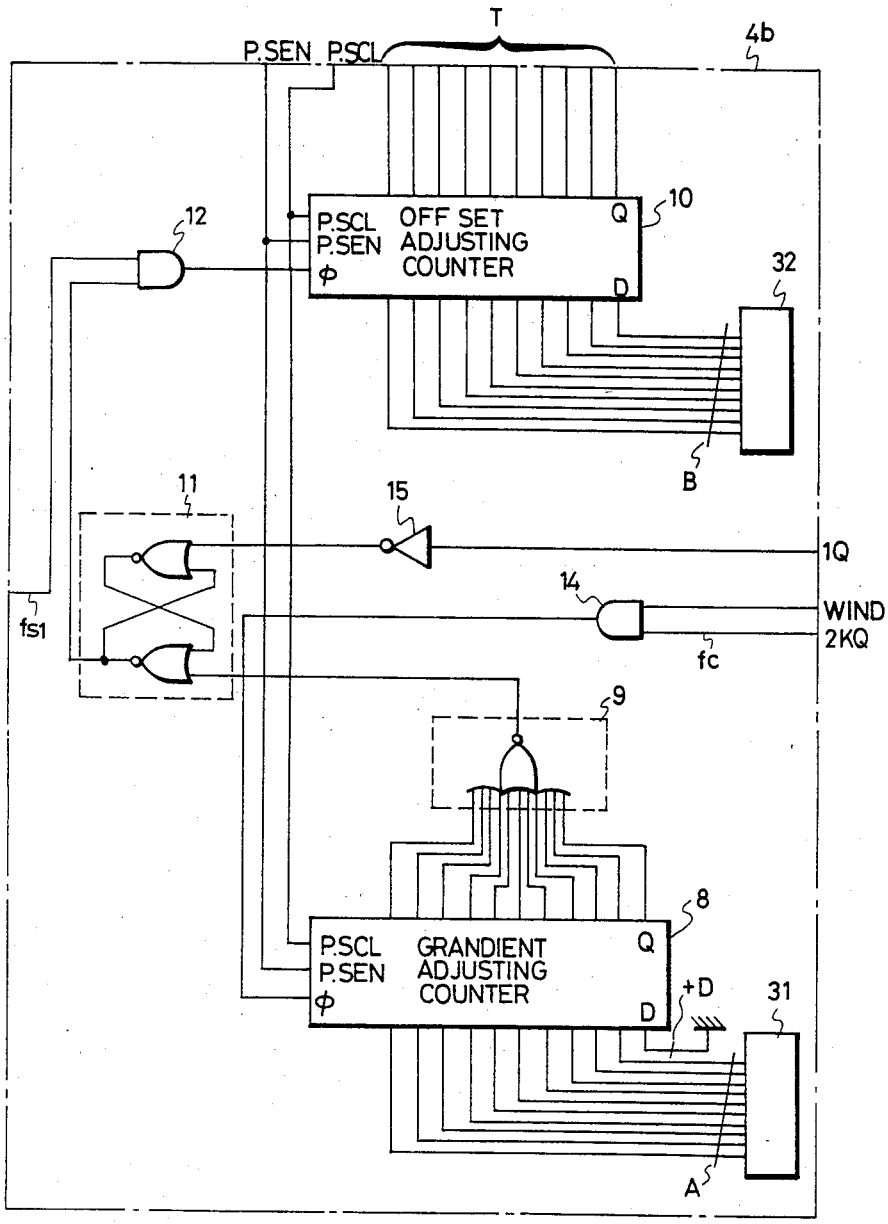
FIG. 5B is a diagram showing specifically the content of the block 4*b* appearing in FIG. 1.
Figure 5C:
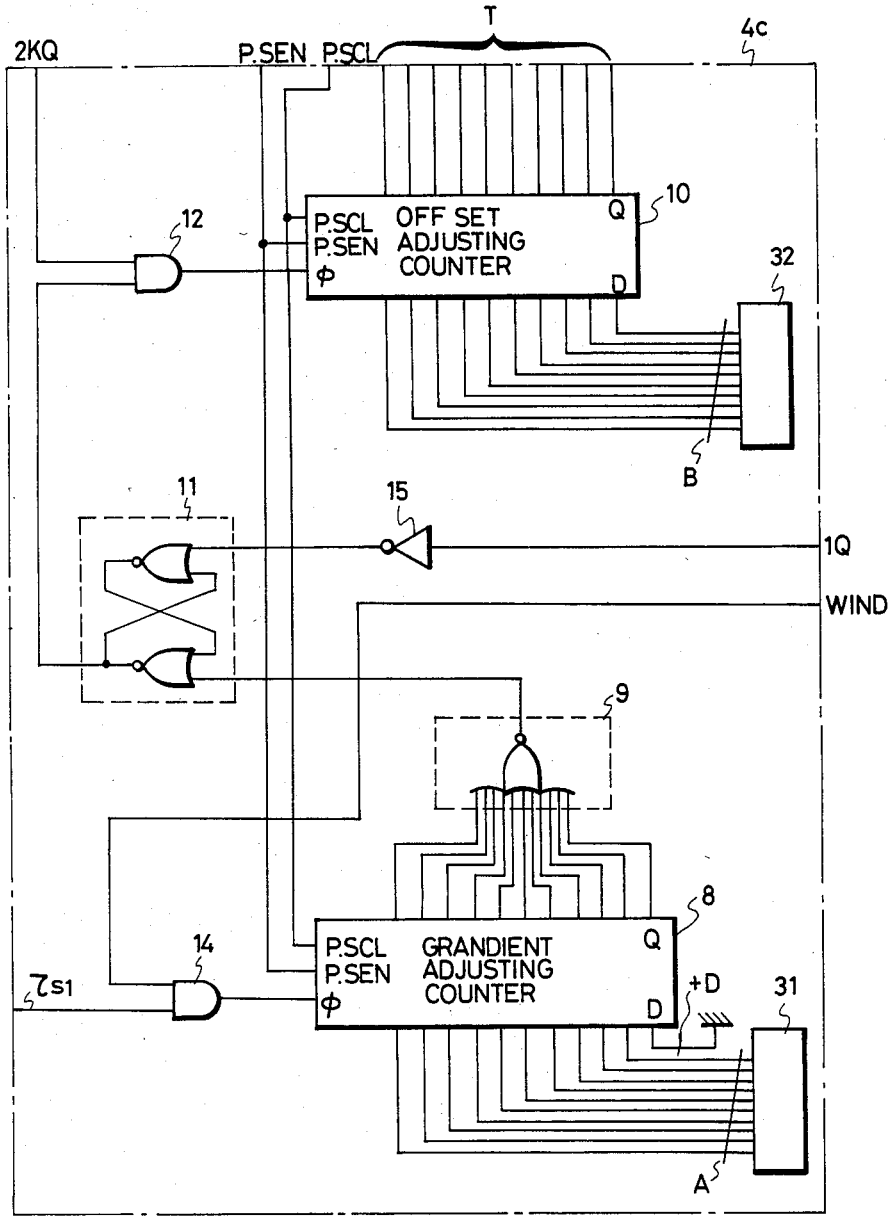
FIG. 5C is a diagram showing specifically the content of the block 4*c* appearing in FIG. 2.
Figure 6:
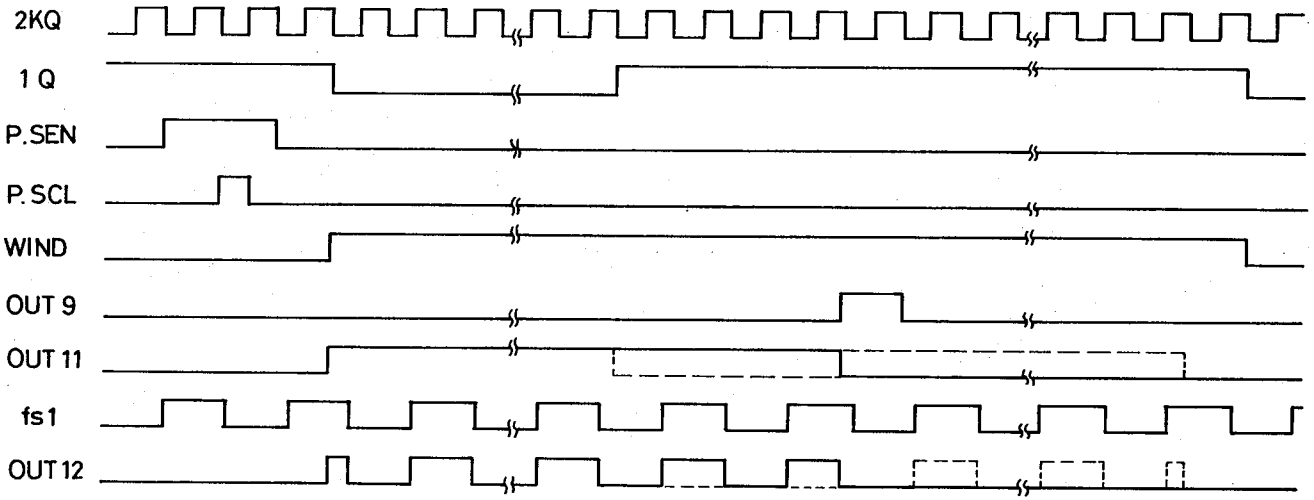
FIG. 6 is a time chart for explaining the operations of FIG. 5B.

FIGS. 5A and 5B are diagrams showing specifically the contents of blocks 4*a* and 4*b* appearing in the block diagram of FIG. 1, respectively, and FIG. 6 is a timing chart for explaining the operations of those blocks 4*a* and 4*b*. In FIG. 5, the temperature sensitive oscillator 7 outputs the output signal frequency fs varying linearly with the temperature, and this output signal frequency fs is inputted to a frequency dividing step 50. A selector 40 is composed of eight transmission gates (which will be shortly referred to as "T.G.") and a decoder, and one of the eight T.G. is selectively turned on at the numerical value which is set in the roughly temperature gradient adjusting numerical information C (which will be shortly referred to as the "adjusting numerical value C") of three bits. The resultant output signal $f_{s1}$ is expressed by the following equation:

$$f_{s1}=fs/2^c \quad (9).$$

On the other hand, the finely temperature gradient numerical information A (which will be referred to as the "adjusting numerical value A") is composed of 10 bits and takes a value of 0 to 1023. The adjusting numerical value A is inputted to the lower 10 bits of the input D of the gradient adjusting presetable down counter 8 (which will be referred to as the "gradient adjusting counter") composed of 11 bits. Since the highest bit of the input D is fixed at "1", the value to be preset in the gradient adjusting counter is the adjusting numerical value A +1. An output signal WIND (which sill be shortly referred to the "WIND") from the controller 6 and the output signal 2KQ (which will be shortly referred to the "2KQ") from the frequency dividing step are inputted to an AND14, the output of which is inputted to a gradient adjusting counter $\phi$. The outputs Q of 11 bits of the gradient adjusting counter are all inputted to the zero detector 9, the output (which will be referred to the "OUT9") of which is inputted to the reset of the R-S latch 11. This R-S latch 11 has its set fed with the signal which is prepared by inverting the output signal 1Q (which will be shortly referred to as the "1Q") of 1 Hz from the frequency dividing step by an inverter 15. The output signal (which will be referred to as the "OUT11") of the R-S latch and the output signal $f_{s1}$ are inputted to the AND12, the output (which will be referred to as the "OUT12") of which is inputted to the $\phi$ of the offset adjusting presetable counter 10 (which will be referred to as the "offset adjusting counter"). The offset adjusting numerical information B (which will be referred to as the "adjusting numerical value B") is composed of 10 bits and takes a value of 0 to 1023. The adjusting numerical value B is inputted to the D of the offset adjusting counter composed of 10 bits. The 10-bit output Q of the offset adjusting counter becomes the temperature information T and is inputted to a frequency corrector 5.

Next, the operations will be described in the following with reference to the time chart of FIG. 6. When an instant for the temperature measurement comes, the output signal P.SEN (which will be referred to as the "P.SEN") is first outputted from the controller 6 immediately from the fall of the 1Q so that the gradient adjusting counter and the offset adjusting counter are set in their preset states. Moreover, the output signal P.SCL (which will be referred to as the "P.SCL") is outputted from the controller 6 to preset the gradient adjusting counter and the offset adjusting counter with the adjusting numerical values A and B, respectively. Next, the OUT11 rises with the fall of the 1Q and begins to be inputted to the $\phi$ of the offset adjusting counter via the AND12. Simultaneously with this, the WIND begins to rise, and the 2KQ begins to be inputted to the $\phi$ of the gradient adjusting counter via the AND14. If the gradient adjusting counter is counted down by the adjusting numerical value A+1024 by the 2KQ, the zero detector 9 conducts its zero detection, and the OUT9 rises. Since the R-S latch 11 is reset by the OUT9 so that the OUT11 falls, the output signal $f_{s1}$ is forbidden by the AND12. The resultant temperature information can be expressed by the following equation:

$$T=[(A+1024).fs/2^c.2048]+B-2^{10}.m \quad (10),$$

wherein $$fs=\alpha.\theta+fo \quad (2).$$

Figure 7:
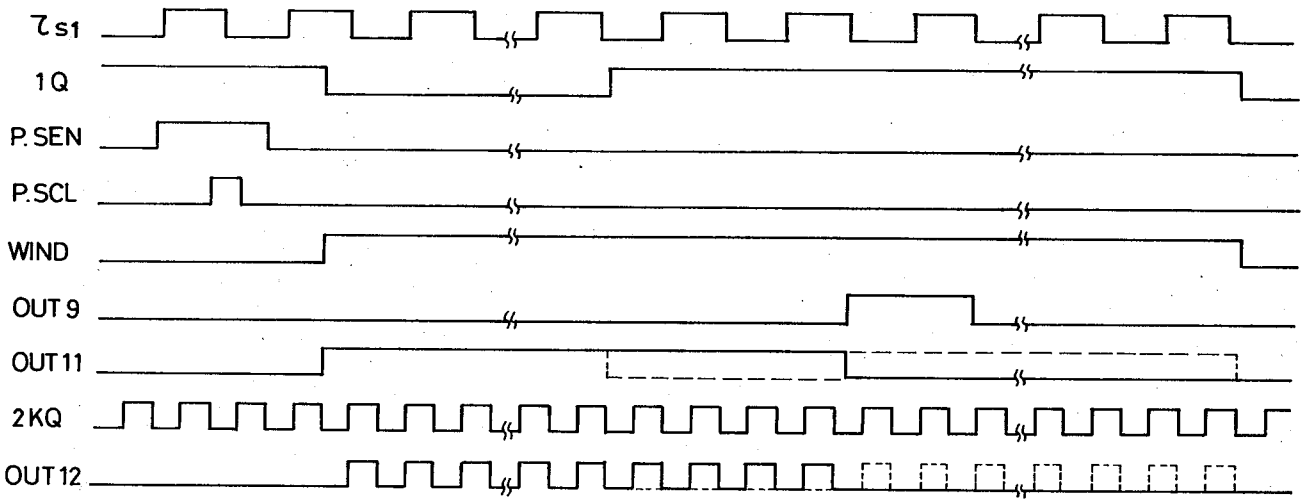
FIG. 7 is a time chart for explaining the operations of FIG. 5C.

FIGS. 5A and 5C are diagrams showing specifically the contents of the blocks 4a and 4c in the block diagram of FIG. 2, and FIG. 7 is a time chart for explaining the operations of those blocks. In FIG. 5A, it is assumed that the temperature sensitive oscillator 7 have its output period $\tau s$ varying linearly with the temperature. Like the case in which the aforementioned output frequency fs varies linearly with the temperature, the output signal $\tau_{s1}$ is expressed by the following equation:

$$\tau_{s1}=\tau s\times 2^c \quad (13).$$

On the other hand, the construction of FIG. 5C is substantially the same as that of FIG. 5B. The difference resides in that the output signal $\tau_{s1}$ is inputted to the AND14 whereas the 2KQ is inputted to the AND12.

Next, the operations will be described in the following with reference to the time chart of FIG. 7. Like the foregoing case of FIG. 6, the adjusting numerical values A and B are preset in the gradient adjusting counter and the offset adjusting counter, respectively, by the P.SEN and the P.SCL. Next, in response to the fall of the 1Q, the OUT11 rises so that the 1KQ begins to be inputted to the $\phi$ of the offset adjusting counter via the AND12. Simultaneously with this, the output signal $\tau_{s1}$ begins to be inputted to the $\phi$ of the gradient adjusting counter via the AND14 in response to the rise of the WIND. When the gradient adjusting conter is counted down by the adjusting numerical value A+1024 in response to the output signal $\tau_{s1}$, the zero detector 9 conducts its zero detection so that the OUT9 rises. Since the R-S latch 11 is reset by the OUT9 so that the OUT11 falls, the 2KQ is forbidden by the AND12. The resultant temperature information T can be expressed by the following equation:

$$T=[\tau s\times 2^c(A+1024)\times 2048]+B-2^{10}.m \quad (14),$$

wherein $$\tau s=\beta.\theta+\tau o \quad (4).$$

The temperature gradient adjusting range in the case of the present invention will be deduced in the following under the same conditions as those of the case of the conventional example. If the temperature information T has a term $T_\theta$ depending upon the temperature, this term $T_\theta$ can be expressed by the following equation from the equations 10) and (2):

$$T_\theta=[(A+1024).\alpha\theta/2^c.2048] \quad (11).$$

Under the same condition as that of the conventional example, in which the temperature information $T_\theta$ varies by 1024 with the variation of the temperature $\theta$ of 102.4° C., then:

$$[(A+1024).\alpha/2^c.2048]=10(1/°C.) \quad (12).$$

Figure 8:
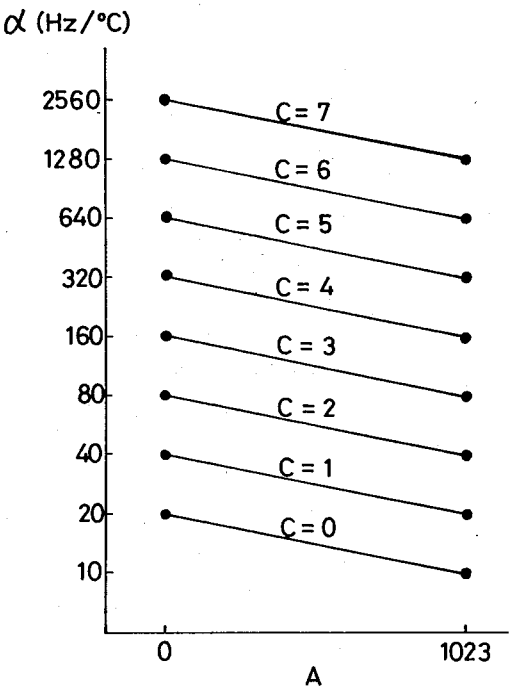
FIG. 8 is a diagram plotting the relation between the temperature gradient adjusting range and the adjusting numerical valves A and C of FIGS. 5A and 5B of the embodiment of the present invention.

Since the adjusting numerical values A and C can take 0 to 1023 and 0 to 7, respectively, the adjustable range of the temperature gradient $\alpha$ can calculated from the equation (12) so that the following very wide gradient adjusting range can be achieved, as shown in FIG. 8:

$$\alpha = 10 \text{ to } 2560(\text{Hz}/^\circ\text{C.}).$$

In the present invention, too, the adjusting numerical value A makes an error of 0.5 at the maximum for adjustment because it takes an integer. The influences to be given to the temperature information $T_\theta$ by the error of 0.5 and the temperature gradient adjusting numerical value A like the case of the conventional example. Since, however, the gradient adjusting counter is operated in the present invention by the value which is prepared by adding the certain constant value D to the adjusting numerical value A, the temperature gradient adjusting resolution is 1/1024 or less even if the adjusting numerical value A is in the neighborhood of zero, in the case of the embodiment of D=1024.

Next, the temperature sensitive oscillator 7 having externally controllable constant voltage circuit will be described.

Figure 9:
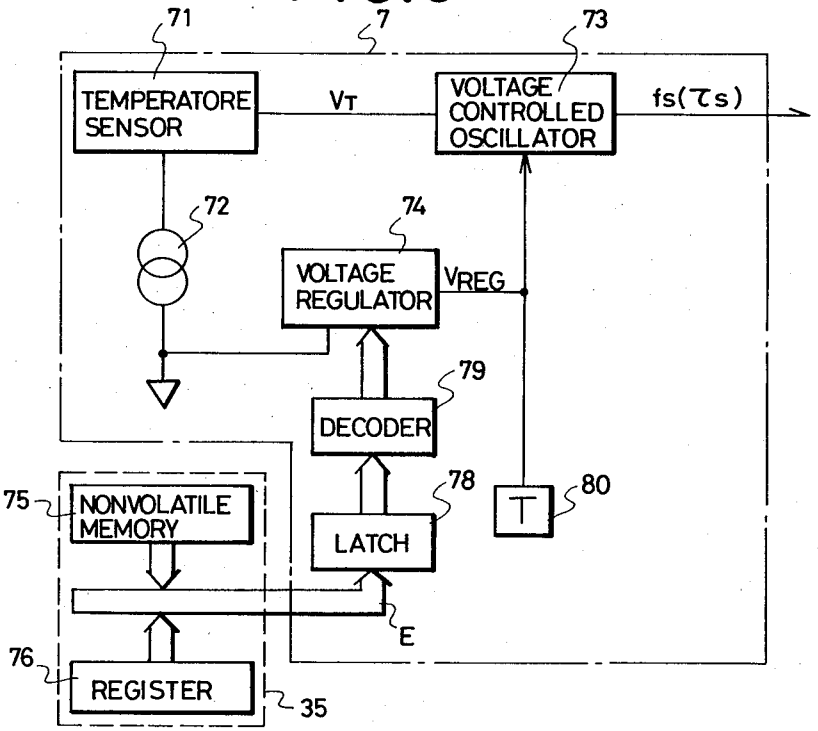
FIG. 9 is a block diagram showing specifically the temperature sensitive oscillator.

FIG. 9 shows a block diagram of the temperature sensitive oscillator 7 and numerical information E 35 for finely regulation of a constant voltage value. A temperature sensor 71 is composed of an IC sensor which is fabricated on an LSI, and a constant current circuit 72 improves a linearity of output voltage versus temperature of the temperature sensor 71. An output frequency of a voltage controlled oscillator 73 is influenced by an output $V_T$ of the temperature sensor 71, so that the temperature change is converted into the frequency change. The voltage controlled oscillator 73 is supplied a constant voltage $V_{REG}$ by a voltage regulator 74. An optimum numerical value E is inputted to the voltage regulator 74 from external side through a latch 78 and a decoder 79 in order to obtain a wide linearity range of the frequency fs versus the temperature. The numerical value E is set to the register 76 by monitoring a test terminal 80, then after fixing the optimum value E, it is stored in a nonvolatile memory 75.

Figure 10:
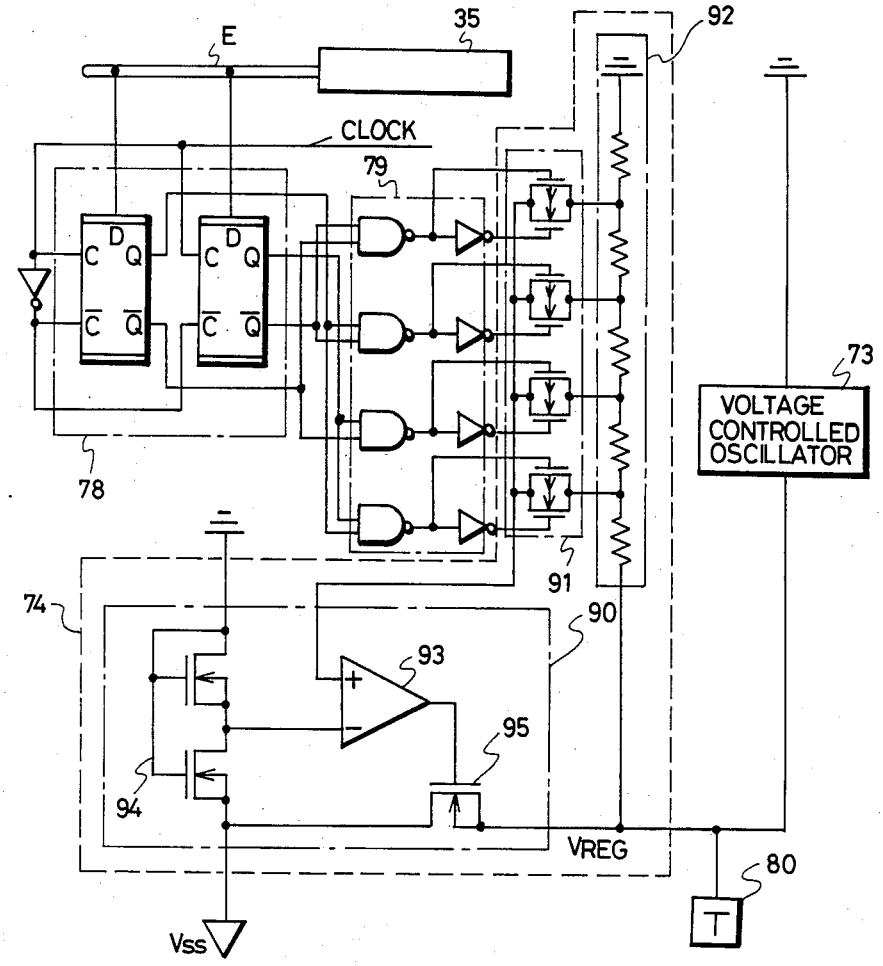
FIG. 10 is a circuit diagram showing the voltage regulator.

FIG. 10 is a circuit diagram showing the detail of the voltage regulator 74, latch 78, and decoder 79. In FIG. 10, a block enclosed by broken lines corresponds to the aforementioned voltage regulator 74 of FIG. 9 including the voltage dividing resistors and the analog switches. On the other hand, a block 90 enclosed by single-dotted lines corresponds to a constant voltage generator for generating a constant voltage to determine a constant voltage to be applied to a voltage controlled oscillator 73. Then, the constant voltage value is monitored by the test terminal 80 so that a correcting value is inputted to a register 76 if it is offset from the target value. The correcting value inputted to that frequency divider is transferred through a half latch 78 to a decoder 79, which in turn determines in accordance with the correcting value what of analog switches 91 is to be turned ON/OFF. As a result, the divided voltages generated by a group of voltage dividing resistors 92 are inputted to an OP amplifier 93 in the constant voltage generator 90 so that they are compared with a reference voltage generated from a reference voltage generator 94 to vary the gate voltage of a MOS resistor 95. As a result, the constant voltage $V_{REG}$ is varied. If this constant voltage $V_{REG}$ is not satisfactory, the aforementioned operations are repeated by inputting again a new correcting value. When the value of the constant voltage $V_{REG}$ has been regulated, on the other hand, it is written in the nonvolatile memory 75. If the correcting value is then read out, if necessary, from the nonvolatile memory and latched in the half latch 78, an optimum constant voltage is obtained as the value $V_{REG}$.

According to the present invention the temperature gradient adjusting range can be widened without any drop in the temperature gradient adjusting resolution. More specifically, it is possible to adjust even the larger dispersions of the temperature gradient of the temperature sensitive oscillator which is made monolithic in the MOS-IC. Moreover, the linearity of frequency versus temperature is optimized by external adjustable voltage regulator. This makes it easy to design the temperature sensitive oscillator and to perform the process control for the IC fabrication while reducing the fraction defective and the production cost.

What is claimed is:

1. An electronic watch comprising:

a quartz oscillator (1) having temperature characteristics;

a frequency divider (2) for generating a train of signals having a lower frequency from the oscillating signal of said quartz oscillator (1);

a driver (3) for composing the output signal train of said frequency divider (2) to generate a drive signal;

a display unit (20) for displaying the time on the basis of the output signal of said driver (2);

a temperature sensitive oscillator (7) having its output signal frequency or period varying linearly with the temperature in the vicinity of said quartz oscillator (1);

a temperature gradient adjustor (8) for logically adjusting the temperature gradient of the output signal frequency or period of said temperature sensitive oscillator (7);

an off set adjustor (10) for logically adjusting the offset of the temperature characteristics of the output signal frequency or period of said temperature sensitive oscillator (7);

a frequency compensator (5) for conducting the temperature compensation of said quartz oscillator (1) on the basis of the temperature information which is prepared from the output signal of said temperature sensitive oscillator (7) by said gradient adjustor (8) and said offset adjustor (10); and a controller (6) for composing the output signal train of said frequency divider (2) to control said temperature sensitive oscillator (7), said temperature gradient adjuster (8) and said offset adjustor (10), characterized: in that a temperature gradient adjusting variable frequency divider (13) is added for variably dividing the frequency of the output signal of said temperature sensitive oscillator (7); and in that said temperature gradient adjustor (8) is operated at a value which is prepared by adding a constant numerical value (D) to the temperature gradient adjusting numerical information (31).

2. An electronic watch as claimed in claim 1, wherein the division ratio of said variable frequency divider (13) is an n-th power (wherein n designates an integer) of 2.

3. An electronic watch as claimed in claim 1, wherein the constant numerical value (A) to be added to said temperature gradient adjusting numerical information (31) is the maximum of said temperature gradient adjusting numerical information plus 1.

4. An electronic watch as claimed in claim 1, further comprising:

a voltage regulator (74) for regulating a supply voltage ($V_{REG}$) for said temperature sensitive oscillator (7);

a voltage adjusting means (35) for applying a correcting value to said voltage regulator (74) from external side; and a nonvolatile memory (75) for semipermanentry storing said correcting value when a desired regulated voltage is obtained at the value of said correcting value by said voltage adjusting means (35).

* * * * *